US010143297B2

(12) United States Patent
Lee

(10) Patent No.: US 10,143,297 B2
(45) Date of Patent: Dec. 4, 2018

(54) PORTABLE INTERDENTAL TOOTHBRUSH

(71) Applicant: Sang Geun Lee, Gwangju-si (KR)

(72) Inventor: Sang Geun Lee, Gwangju-si (KR)

( * ) Notice: Subject to any disclaimer, the term of this patent is extended or adjusted under 35 U.S.C. 154(b) by 0 days.

(21) Appl. No.: 14/904,748

(22) PCT Filed: Oct. 28, 2015

(86) PCT No.: PCT/KR2015/011398

§ 371 (c)(1),
(2) Date: Jan. 13, 2016

(87) PCT Pub. No.: WO2017/014360

PCT Pub. Date: Jan. 26, 2017

(65) Prior Publication Data

US 2018/0116389 A1 May 3, 2018

(30) Foreign Application Priority Data

Jul. 23, 2015 (KR) ..... 10-2015-0104196

(51) Int. Cl.

| | |
|---|---|
| ***A46B 11/00*** | (2006.01) |
| ***A46B 5/00*** | (2006.01) |
| ***A46B 15/00*** | (2006.01) |
| ***A46B 17/04*** | (2006.01) |

(52) U.S. Cl.

CPC ..... *A46B 11/0041* (2013.01); *A46B 5/0095* (2013.01); *A46B 11/0006* (2013.01); *A46B 11/0062* (2013.01); *A46B 11/0065* (2013.01); *A46B 15/0069* (2013.01); *A46B 15/0091* (2013.01); *A46B 15/0097* (2013.01); *A46B 17/04* (2013.01); *A46B 2200/108* (2013.01)

(58) Field of Classification Search

CPC ..... A46B 5/095; A46B 11/0086; A46B 2200/108; B65D 1/06; B65D 41/28

See application file for complete search history.

(56) References Cited

U.S. PATENT DOCUMENTS 3,734,106 A * 5/1973 Zimmerman ..... A46B 5/0095 132/311
9,814,301 B2 * 11/2017 Lee ..... A46B 5/0095
9,907,390 B2 * 3/2018 Lee ..... A46B 9/04

(Continued)

FOREIGN PATENT DOCUMENTS

JP 2001-137103 A 5/2001
JP 2007210648 A * 8/2007 ..... A46B 5/0095

(Continued)

*Primary Examiner* — David Angwin
*Assistant Examiner* — Bradley Oliver
(74) *Attorney, Agent, or Firm* — Korus Patent, LLC; Seong Il Jeong

(57) ABSTRACT

Provided is a portable interdental toothbrush that includes a cleaning solution tube configured to contain a cleaning solution, and a brush body. The cleaning solution tube includes an assembly protrusion for discharging the cleaning solution formed in an upper part of the cleaning solution tube, an injection hole for filling with the cleaning solution formed in a lower part of the cleaning solution tube, and an injection hole cover for closing the injection hole. The brush body includes an assembly hole into which the assembly protrusion is inserted and assembled, and a brush fixing portion fixed in an upper part of the brush body.

7 Claims, 5 Drawing Sheets

(56) References Cited

U.S. PATENT DOCUMENTS

| | | | | |
|---|---|---|---|---|
| 2005/0032019 | A1* | 2/2005 | Han | A46B 3/18 433/80 |
| 2005/0147460 | A1* | 7/2005 | Han | A46B 7/04 401/270 |
| 2012/0077145 | A1* | 3/2012 | Tsurukawa | A46B 5/0095 433/82 |
| 2012/0219350 | A1* | 8/2012 | Han | A46B 5/0095 401/268 |
| 2013/0130196 | A1* | 5/2013 | Joyashiki | A61C 15/00 433/87 |
| 2015/0033482 | A1* | 2/2015 | Miles | A46B 11/0041 15/104.94 |
| 2017/0164726 | A1* | 6/2017 | Lee | A46B 9/04 |
| 2017/0224099 | A1* | 8/2017 | Lee | A46B 5/0095 |

FOREIGN PATENT DOCUMENTS

| | | | |
|---|---|---|---|
| KR | 20-0246271 | Y1 | 10/2001 |
| KR | 10-2004-0008970 | A | 1/2004 |
| KR | 10-2008-0006355 | A | 1/2008 |
| KR | 20-2012-0007150 | U | 10/2012 |
| KR | 10-2013-0128009 | A | 11/2013 |
| KR | 10-1500260 | B1 | 3/2015 |
| KR | 10-1500288 | B1 | 3/2015 |
| WO | 2003/018330 | A1 | 3/2003 |
| WO | 2014/065817 | A1 | 5/2014 |

* cited by examiner

PORTABLE INTERDENTAL TOOTHBRUSH

CROSS-REFERENCE TO RELATED APPLICATION(S)

This application claims the benefit of International Application No. PCT/KR2015/011398, filed on Oct. 28, 2015, based on Korean Patent Application No. 10-2015-0104196, filed on Jul. 23, 2015, the disclosure of which is hereby incorporated by reference herein in its entirety.

BACKGROUND

1. Technical Field

The present invention relates to a portable interdental toothbrush and is more particularly concerned with a portable interdental toothbrush in which a user can carry for portable use during travel or outing so as to clean and sterilize foreign materials and plaque that fit between teeth after meals; the interdental toothbrush can be conveniently used by rotating a cleaning solution tube or a brush body once to open; even if it is used in a state where the cleaning solution is discharged upon rotating the cleaning solution tube to open and then pressing the cleaning solution tube, it can be used comfortably without shaking of the brush body to which the brush is fixed; when rotating the cleaning solution tube in an opposite direction after use, the discharge of the cleaning solution is blocked and so the discharge of the cleaning solution is easily controlled; the injection of the cleaning solution becomes convenient by fixing the injection hole cover to the lower end of the cleaning solution tube to facilitate the injection of the cleaning solution; mass production is possible, it can be provided at a low price, and its use is convenient.

2. Description of the Related Art

In general, the interdental toothbrush has small brush-shaped bristles for cleaning spaces between the teeth mounted on the end of the handle. They are orally hygiene instruments used to clean the oral cavity by washing interdental spaces using putting in and pulling out motions of the brush in the interdental space gaps. Use of the interdental toothbrush facilitates removal of food-residue and plaque of hard-to-reach areas of usual toothbrushes, sterilization after dental treatment such as scaling, prevention of plaque after smoking, and cleaning of orthodontic instruments such as braces to maintain oral hygiene.

However, looking at the actual state of use of the current interdental brush, there are problems that the cleaning is conducted only using the brush and thus gums become stimulated, bleeding occurs frequently and the ability to remove food-residue and plaque becomes insufficient. Further, if interdental brushes are continuously used, there is an unpleasant smell from the brush due to a bad cleanliness, particularly, the growth of bacteria.

In an attempt to solve the above-mentioned problems, several interdental toothbrushes have been suggested including Korean Patent No. 10-1500288 titled 'portable interdental toothbrush' of the present applicant. However, there is a crucial problem in the above Korean Patent that a cleaning solution inflow hale of a cleaning solution tube storing a cleaning solution through which the cleaning solution is injected is formed on an assembly protrusion having a small diameter which only allows manual operation using a syringe and the like to inject a large amount of the cleaning solution, thereby incapacitating mass production. Further, there is a problem in which, in case that it is used while the cleaning solution is discharged by rotating the cleaning solution tube or a brush body to discharge the cleaning solution, the brush body to which a brush is fixed is fixed incompletely, which makes the brush unable to brush the teeth properly.

SUMMARY

It is an object of the present invention to solve the above-described problems and to provide a portable interdental toothbrush in which, when using the interdental toothbrush, even if it is used in a state where the cleaning solution is discharged upon rotating the cleaning solution tube once to open and then pressing the cleaning solution tube, it can be used comfortably without shaking of the brush body to which the brush is fixed; when rotating the cleaning solution tube once rat an opposite direction after use, the discharge of the cleaning solution is blocked and so the discharge of the cleaning solution is easily controlled; an injection hole cover is fixed to a lower end of the cleaning solution tube to facilitate the injection of the cleaning solution and so the injection of the cleaning solution becomes convenient; mass production is possible, it can be provided at a low price, and its use is convenient.

The above objects of the present invention is achieved by a portable interdental toothbrush according to the present invention comprising a cleaning solution tube in which a cleaning solution is received to be carried conveniently, an assembly protrusion for discharging the cleaning solution is formed in the upper part, an injection hole for filling with the cleaning solution is formed in the lower part, and an injection hole cover for closing the injection hole after injection is attached; and a brush body in which an assembly hole into which the assembly protrusion of the cleaning solution tube is inserted and assembled is formed in the lower part to be assembled to the assembly protrusion of the cleaning solution tube and a brush fixing portion is fixed in the upper part.

The portable interdental toothbrush according to the present invention comprises: a cleaning solution tube in which a cleaning solution is received to be carried conveniently, an assembly protrusion for discharging the cleaning solution is formed in the upper part, an injection hole for filling with the cleaning solution is formed in the lower part; and an injection hole cover for closing the injection hole after injection is attached, and a brush body in which an assembly hole into which the assembly protrusion of the cleaning solution tube is inserted and assembled is formed in the lower part to be assembled to the assembly protrusion of the cleaning solution tube and a brush fixing portion is fixed in an upper part, thereby the present portable interdental toothbrush has the following excellent effects: when using the interdental toothbrush, even if it is used in a state where the cleaning solution is discharged upon rotating the cleaning solution tube once to open and then pressing the cleaning solution tube, it can be used comfortably without shaking of the brush body to which the brush is fixed; when rotating the cleaning solution tube once is an opposite direction after use, the discharge of the cleaning solution is blocked and so the discharge of the cleaning solution is easily controlled; the injection hole cover is fixed to the lower end of the cleaning solution tube to facilitate the injection of the cleaning solution and so the injection of the cleaning solution becomes convenient; mass production is possible, it can be provided at a low price, and its use is convenient.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1A:
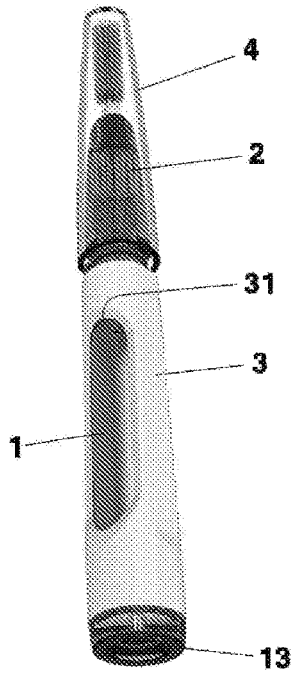
FIGS. 1*a* and 1*b* are perspective views of a portable interdental toothbrush and a cleaning solution tube in which a brush body is removed in accordance with the first embodiment of the present invention, respectively.

Hereinafter, the configuration and operation of preferred embodiments of the present invention will be described in detail with reference to the accompanying drawings. Here, in the case of assigning the reference numerals to the components of the drawings, it should be noted that, with respect to the same components, the same reference numerals are used even in different drawings.

Figure 1B:
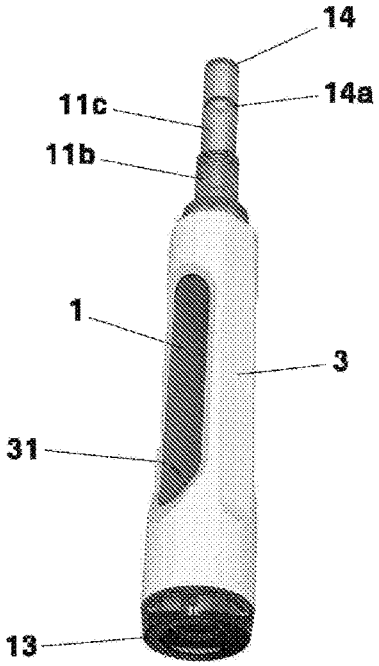
Figure 2:
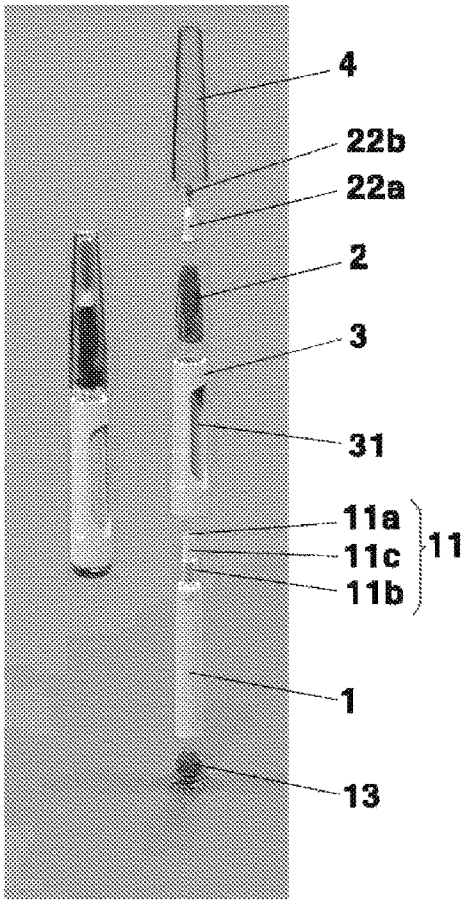
FIG. 2 is an exploded perspective view of a portable interdental toothbrush in accordance with the first embodiment of the present invention.

As shown in FIGS. 1 to 3, a portable interdental toothbrush (A) in accordance with the first embodiment of the present invention comprises: a cleaning solution tube 1 in which a cleaning solution is received to be carried conveniently, an assembly protrusion 11 for discharging the cleaning solution is formed in the upper part, an injection hole 12 for filling with the cleaning solution is formed in the lower part, and an injection hole cover 13 for closing the injection hole 12 after injection is press-fitted; and a brush body 2 in which an assembly hole 21 into which the assembly protrusion 11 of the cleaning solution tube 1 is inserted and assembled is formed in the lower part to be assembled to the assembly protrusion 11 of the cleaning solution tube 1 and a brush fixing portion 22 is fixed in the upper part.

A discharge hole 11*a* for discharging the cleaning solution is formed in a longitudinal direction in the center of the assembly protrusion 11 of the cleaning solution tube 1, a screw portion 11*b* formed on a lower end of an outer surface thereof, and an extended portion from the screw portion 11*b* is formed such that an support extension 11*c* is extended such that the support extension 11*c* prevents the cleaning solution from flowing back by the extended length and supports the brush body 2 without shaking.

As shown in FIG. 1*b*, a gripping rod 14 having a cutting groove 14*a* is formed in the upper part of the discharge hole 11*a* of the assembly protrusion 11 of the cleaning solution tube 1 such that the discharge hole 11*a* is sealed by the gripping rod 14 which enables a long time storage of the cleaning solution C in the cleaning solution tube 1. When using the portable interdental toothbrush, the user may fold and break the cutting groove 14*a* of the gripping rod 14 for the cutting groove 14*a* to be cut out to open the sealed discharge hole 11*a*. Now, a new brush body 2 stored in a storage box 6 illustrated in FIG. 5 may be assembled on the opened discharge hole 11*a* to use.

The inflow hole 12 is formed in the lower end of the cleaning solution tube 1 to fill with the cleaning solution, and, after the filling oldie cleaning solution, the injection hole cover 13 is forcibly snap-assembled to prevent the cleaning solution from discharging. A saw-toothed protrusion 12*a* for snap-assembly is formed on the outside of the injection hole 12 of a lower open end 1*a* of the cleaning solution tube 1, and, in the injection hole cover 13 which is snap-assembled hereto, as shown in FIG. 3, a saw-toothed groove 13*a* corresponding to the saw-toothed protrusion 12*a* is formed, which are adhered semipermanently until the use of the cleaning solution C without separation. Further, for the secure sealing and assembling, the injection hole cover 13 has a double-closing structure which covers and closes inside and outside to include a bottom surface of a lower end portion of the open end 1*a* in the lower end of the cleaning solution tube 1, which enables secure sealing and a long time storage of the cleaning solution without evaporation.

As the inflow hole cover 13, a saw-toothed structure can be used, however, it is not limited thereto. It is possible to use a screw structure instead of the saw-toothed protrusion 12*a* and the saw-toothed groove 13*a* or an injection hole cover 13 on which an elastic protrusion 13*c* is formed.

Figure 4A:
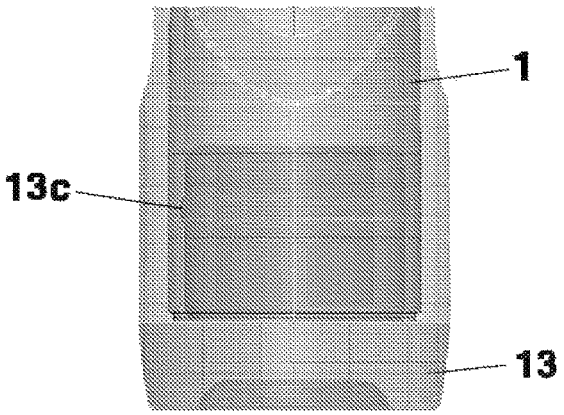
FIGS. 4*a* and 4*b* show another embodiment of an inflow hole cover of a portable interdental toothbrush in accordance with the first embodiment of the present invention.
Figure 4B:
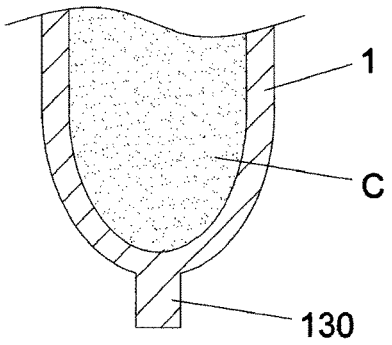

As another embodiment, as shown in FIG. 4*b*, a method of filling the cleaning solution tube 1 with the cleaning solution C through the injection hole 12 and fusing the injection hole 12 with synthetic resins to form a joint 130 may be used.

In the assembly hole 21 formed in the lower part of the brush body 2, a negative screw portion 21*a* is formed in the lower end, a support extension groove 21*b* is formed in the middle, and a fixing hole 21*c* is formed in an upper part. The brush fixing portion 22 is fixed to the fixing hole 21*c* in the upper part of the brush body 2. The brush fixing portion 22 includes a support insertion 22*a* inserted into the fixing hole 21*c* in the upper part of the brush body 2 and a brush 22*b* fixed to the upper part of the support insertion 22*a*. Outflow grooves 221 for out-flowing the cleaning solution C are formed on a side of the support insertion 22*a* in a longitudinal direction such that the cleaning solution C is discharged to the brush 22*b* when it is opened. An insertion protrusion 222 for closing the discharge hole 11*a* is protruded downwardly on the bottom surface of the support insertion 22*a*. Accordingly, in the closed state shown in FIG. 3*a* in which the insertion protrusion 222 protruded on the bottom surface of the support insertion 22*a* is closely adhered to the discharge hole 11 and closed, when discharging the cleaning solution C, as shown in FIG. 3*b*, the brush body 2 is rotated to separate the insertion protrusion 222 from the discharge hole 11*a*, the cleaning solution is discharged through the separated gap and supplied to the brush 22*b* along the outflow grooves 221. If the brush body 2 is rotated in an opposite direction, the insertion protrusion 222 is closely adhered to the discharge hole 11*a* to thereby prevent the cleaning solution C from discharging.

Figure 3A:
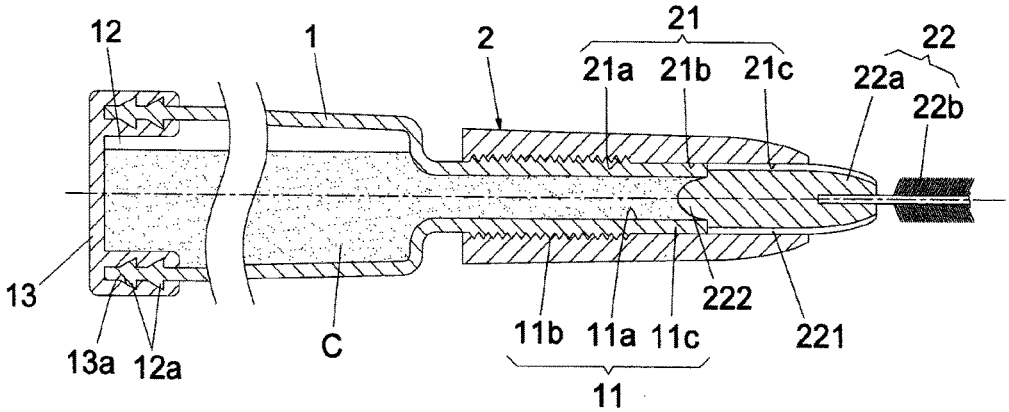
FIGS. 3*a* and 3*b* are schematic longitudinal cross-sectional views of a portable interdental toothbrush in accordance with the first embodiment of the present invention when it is closed and open, respectively.
Figure 3B:
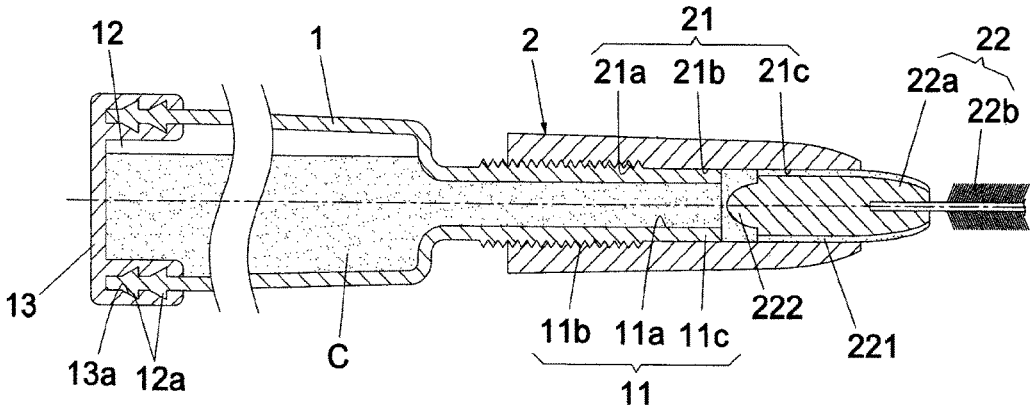

As shown in FIGS. 3*a* and 3*b*, if it is used in a state where the brush body 2 is rotated and opened to discharge the cleaning solution C during use, even if the brush body 2 is slightly moved forward and used, since the support extension 11*c* of the assembly protrusion 11 of the cleaning solution tube 1 is inserted into the support extension groove 21*b* of the brush body 2, the support extension 11*c* is tightly inserted into and supported by the support extension groove 21*b* to support the shaking even if it is shaken during use. As a result, the brush body 2 is supported without shaking, and the backflow of the cleaning solution is prevented by the extension of the support extension 11*c* as well since the support extension 11*c* is long-extended even if there is a backflow of the cleaning solution even for a little while during use.

An elastic cover 3 is covered on the outer surface of the cleaning solution tube 1 for the pushing pressure is well applied, and a brush cover 4 for protecting the brush is covered on the upper part of the brush body 2.

The elastic cover 3 is made of a softer material than that of the cleaning solution tube 1. Further, it has a cylindrical shape and a long groove 31 in the middle having elliptical ends on both sides in a longitudinal direction to make a pressing action on the cleaning solution tube 1 convenient.

In the brush cover 4, the brush 22*b* is inserted to protect the brush 22*b*, and an end portion is inserted and fixed to an outer surface of the cleaning solution tube 1.

Figure 5:
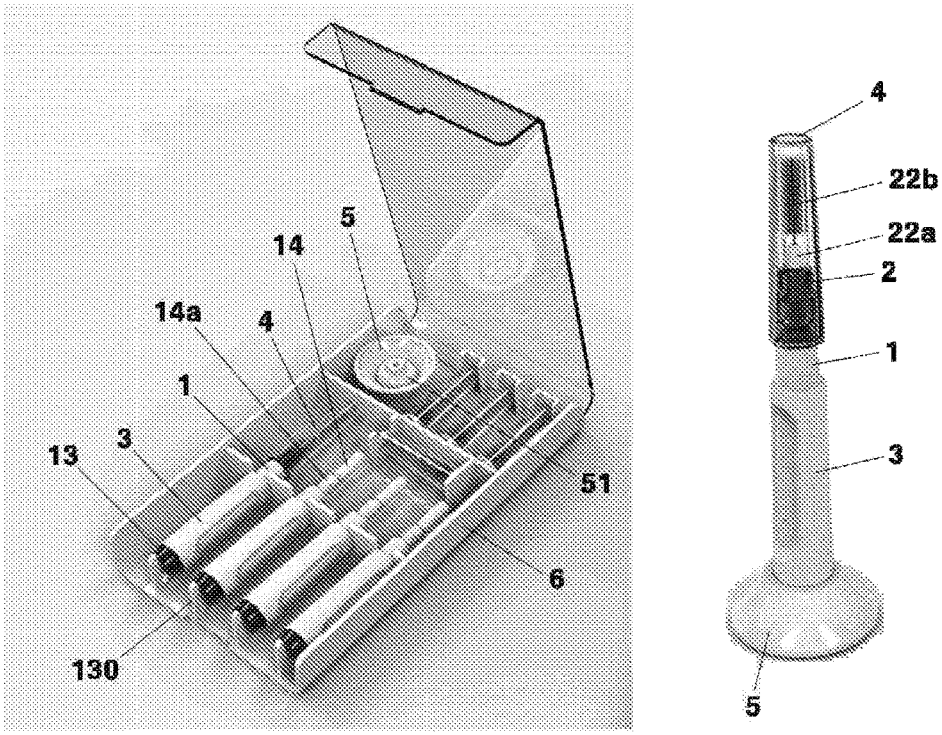
FIG. 5 is perspective views showing the storage state where several portable interdental toothbrushes are stored and the state where the portable interdental toothbrush is stored after use in accordance with the first embodiment of the present invention

FIG. 5 illustrates a set of portable interdental toothbrushes in accordance with the first embodiment of the present invention for sale and the state where the portable interdental toothbrush is stored standing after use. One (1) ready-to-use portable interdental toothbrush A, three (3) preparatory sets of the cleaning solution tube 1 and the brush body 2, and one (1) stand put in the storage box 6 may be a unit of individual sale, and the lower end portion of the cleaning solution tube 1 may be inserted on the stand 5 to keep the portable interdental toothbrush standing. A groove portion 51 into which the lower end portion of the cleaning solution tube 1 is inserted is formed in the center of the stand 5 for the lower end portion of the cleaning solution tube 1 to be inserted and fixed.

The operational effect of the portable interdental toothbrush A in accordance with the first embodiment of the present invention having the above configuration is described below in detail.

First, since the portable interdental toothbrush A in accordance with the first embodiment of the present invention has a wide injection hole 12 formed in the lower end portion thereof, the cleaning solution C may be injected conveniently by a cleaning solution injection apparatus (not shown), thereby enabling mass production. For the lower end portion of the cleaning solution tube 1 in which the injection of the cleaning solution is completed, the injection hole cover 13 may forcibly be snap-assembled to prevent the cleaning solution from discharging, or, as shown in FIG. 4*b*, the injection hole 12 is fused with synthetic resins and sealed and fixed by the joint 130, which finishes the sealing process after filling of the cleaning solution conveniently.

The portable interdental toothbrush A can be used as follows. When the insertion protrusion 222 is separated from the discharge hole 11*a* by the rotation of the brush body 2, it is used in a state where the cleaning solution is discharged through the separated gap and supplied to the brush 22*b* along the outflow grooves 221. At this time, even if the brush body 2 is slightly moved forward and used, the support extension 11*c* of the assembly protrusion 11 of the cleaning solution tube 1 is inserted into the support extension groove 21*b* of the brush body 2. Thus, even if it is shaken during use, the support extension 11*c* is tightly inserted into and supported by the support extension groove 21*b* to support the shaking. As a result, the brush body 2 is supported without shaking, and the user may brush the teeth using the interdental toothbrush A comfortably.

Moreover, since, the support extension 11*c* of the portable interdental toothbrush A is long-extended, even if the backflow of the cleaning solution C leaked from the cleaning solution tube 1 is temporarily occurred due to the shaking of the interdental toothbrush A or changing of the direction of use, the cleaning solution C flows in a forward direction to the brush 22*b* again by the long extended support extension 11*c* and the backflow is just transient if any. Thus, the portable interdental toothbrush A can be used hygienically.

After use, the portable interdental toothbrush A may be kept standing by inserting the lower end portion of the cleaning solution tube 1 into the stand 5, which enables the user to keep the portable interdental toothbrush A in a neat and organized manner.

Figure 6:
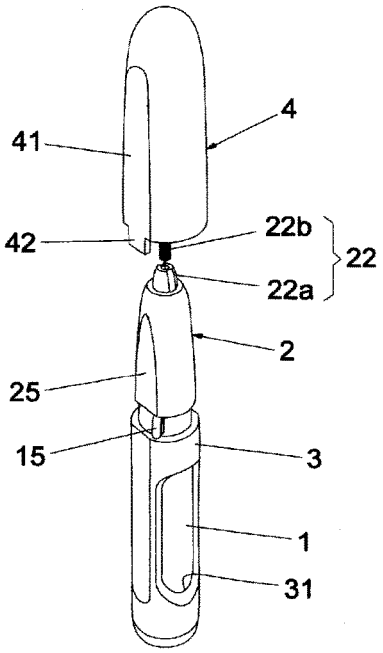
FIG. 6 is a schematic perspective view of a portable interdental toothbrush accordance with the second embodiment of the present invention.

FIG. 6 illustrates a portable interdental toothbrush A in accordance with the second embodiment of the present invention, which is manufactured to be used more conveniently than the portable interdental toothbrush in accordance with the first embodiment and has a similar structure except the following. A planar portion 25 is formed in a pan of an outer side of the brush body 2, a cover planar portion 41 adjacent to the planar portion 25 is also formed on a part of the brush cover 4 inserted into the brush body 2, an engaging protrusion 15 is formed in a lower part of the assembly protrusion 11 of the cleaning solution tube 1, and a protruded extension 42 adjacent to the engaging protrusion 15 is formed in a lower end of the brush cover 4.

Figure 7:
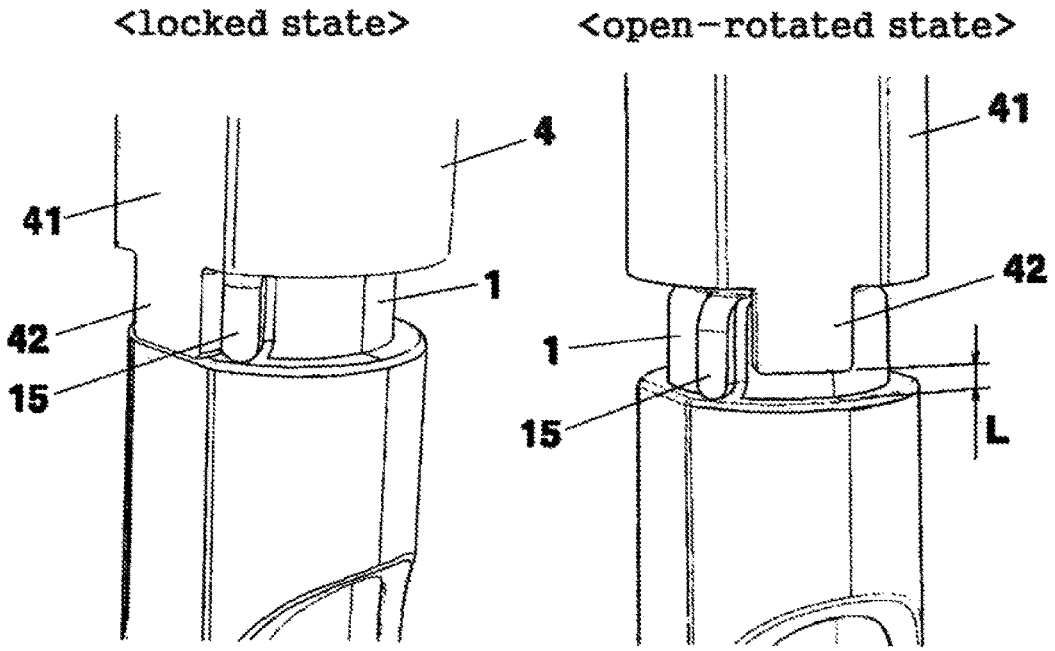
FIG. 7 is a partial perspective view of the portable interdental toothbrush in accordance with the second embodiment of the present invention showing the locked state and the open-rotated state.

The brush cover 4 is inserted into and fixed to the brush body 2. When the user wishes to use the portable interdental toothbrush A, as shown in FIG. 7, if the brush cover 4 is rotated once, then the adjacent cover planar portion 41 applies a force to rotate the planar portion 25 of the brush body 2. Accordingly, the brush body 2 is rotated very easily and the brush body 2 is rotated along the assembly protrusion 11 to rise by a height L, which causes the insertion protrusion 222 to be separated from the discharge hole 11*a* for the cleaning solution C to be discharged. Subsequently, if the protruded extension 42 of the brush cover 4 is caught by the engaging protrusion 15, then it stops and the portable interdental toothbrush A may be used after taking off the brush cover 4. After use, if the brush cover 4 is inserted and rotated in an opposite direction, the adjacent cover planar portion 41 applies a force to rotate the planar portion 25 of the brush body 2. If the brush body 2 is rotated once and the protruded extension 42 of the brush cover 4 is caught by the engaging protrusion 15, then it stops and is locked to prevent the cleaning solution C from discharging. Thus, it is a structure with a more convenient way of use.

It is possible to manufacture the same products as the portable interdental toothbrush in accordance with the present invention repeatedly in the manufacturing field of the interdental toothbrush. Accordingly, the present invention possesses industrial applicability.

Although the specific embodiments of the present invention have been disclosed for illustrative purposes, those skilled in the art will appreciate that various modifications, additions and substitutions may be made to the invention without departing from the scope and spirit of the invention as disclosed in the accompanying claims.

What is claimed is:

1. A portable interdental toothbrush (A) comprising:

a cleaning solution tube (1) configured to contain a cleaning solution, the cleaning solution tube (1) comprising an assembly protrusion (11) for discharging the cleaning solution formed in an upper part of the cleaning solution tube, an injection hole (12) for filling with the cleaning solution formed in a lower part of the cleaning solution tube, and an injection hole cover (13) for closing the injection hole (12) attached to the lower part of the cleaning solution tube; and a brush body (2) comprising an assembly hole (21) into which the assembly protrusion (11) of the cleaning solution tube (1) is inserted and assembled and a brush fixing portion (22) fixed in an upper part of the brush body (2), the assembly hole (21) being formed in a lower part of the brush body (2), wherein the assembly protrusion (11) comprises a discharge hole (11*a*) for discharging the cleaning solution formed in a longitudinal direction in a center of the assembly protrusion (11), a screw portion (11*b*) formed in a lower end of an outer surface of the assembly protrusion (11), and a support extension (11*c*) extending from the screw portion (11*b*); and wherein the assembly hole (21) comprises a female screw portion (21*a*) formed in a lower end of the assembly hole (21), a support extension groove (21*b*) formed in a middle of the assembly hole (21), and a fixing hole (21*c*) formed in an upper part of the assembly hole (21), the brush fixing portion (22) being fixed in the fixing hole (21*c*) in the upper part of the brush body (2), wherein the injection hole cover (13) has a double-closing structure for a secure sealing and assembly which covers and closes inside and outside of an open end in a lower end of the cleaning solution tube (1), the double-closing structure surrounding a bottom surface of the open end.

2. The portable interdental toothbrush of claim 1, wherein a saw-toothed protrusion (12*a*) for snap-assembly is formed on an outside of the injection hole (12) of the open end, and a saw-toothed groove (13*a*) corresponding to the saw-toothed protrusion (12*a*) is formed in the injection hole cover (13), a female screw and a male screw instead of the saw-toothed protrusion (12*a*) and the saw-toothed groove (13*a*) are formed and screw-coupled, or an elastic protrusion (13*c*) is formed on an outer surface of the injection hole cover (13).

3. The portable interdental toothbrush of claim 1, wherein a brush cover (4) for protecting the brush is covered on the upper part of the brush body (2), and a planar portion (25) is formed on a part of an outside of the brush body (2), and a cover planar portion (41) adjacent to the planar portion (25) is also formed on a part of the brush cover (4) inserted into the brush body (2).

4. The portable interdental toothbrush of claim 3, wherein an engaging protrusion (15) is formed in a lower part of the assembly protrusion (11) of the cleaning solution tube (1) and a protruded extension (42) adjacent to the engaging protrusion (15) is formed in a lower end of the brush cover (4).

5. The portable interdental toothbrush of claim 1, wherein a stand (5) is received and stored in a storage box (6) and a groove portion (51) into which the lower end portion of the cleaning solution tube (1) is inserted is formed in a center of the stand (5).

6. The portable interdental toothbrush of claim 1, wherein a gripping rod (14) having a cutting groove (14*a*) is formed on an upper part of the discharge hole (11*a*) such that the discharge hole (11*a*) is sealed by the gripping rod (14) which enables a long time storage of the cleaning solution (C) in the cleaning solution tube (1) and, when using the portable interdental toothbrush, the cutting groove (14*a*) of the gripping rod (14) can be folded and broken for the cutting groove (14*a*) to be cut out to open the sealed discharge hole (11*a*) which makes the portable interdental toothbrush to be a usable state.

7. A portable interdental toothbrush (A) comprising:

a cleaning solution tube (1) configured to contain a cleaning solution, the cleaning solution tube (1) comprising an assembly protrusion (11) for discharging the cleaning solution formed in an upper part of the cleaning solution tube, an injection hole (12) for filling with the cleaning solution formed in a lower part of the cleaning solution tube, and an injection hole cover (13) for closing the injection hole (12) attached to the lower part of the cleaning solution tube; and a brush body (2) comprising an assembly hole (21) into which the assembly protrusion (11) of the cleaning solution tube (1) is inserted and assembled and a brush fixing portion (22) fixed in an upper part of the brush body (2), the assembly hole (21) being formed in a lower part of the brush body (2), wherein the assembly protrusion (11) comprises a discharge hole (11*a*) for discharging the cleaning solution formed in a longitudinal direction in a center of the assembly protrusion (11), a screw portion (11*b*) formed in a lower end of an outer surface of the assembly protrusion (11), and a support extension (11*c*) extending from the screw portion (11*b*); and wherein the assembly hole (21) comprises a female screw portion (21*a*) formed in a lower end of the assembly hole (21), a support extension groove (21*b*) formed in a middle of the assembly hole (21), and a fixing hole (21*c*) formed in an upper part of the assembly hole (21), the brush fixing portion (22) being fixed in the fixing hole (21*c*) in the upper part of the brush body (2), wherein a brush cover (4) for protecting the brush is covered on the upper part of the brush body (2), and a planar portion (25) is formed on a part of an outside of the brush body (2), and a cover planar portion (41) adjacent to the planar portion (25) is also formed on a part of the brush cover (4) inserted into the brush body (2), wherein an engaging protrusion (15) is formed in a lower part of the assembly protrusion (11) of the cleaning solution tube (1) and a protruded extension (42) adjacent to the engaging protrusion (15) is formed in a lower end of the brush cover (4).

* * * * *